US011873601B2

(12) United States Patent
An et al.

(10) Patent No.: US 11,873,601 B2
(45) Date of Patent: Jan. 16, 2024

(54) LAUNDRY TREATING APPARATUS

(71) Applicant: LG Electronics Inc., Seoul (KR)

(72) Inventors: Yongjun An, Seoul (KR); Seongno Yoon, Seoul (KR)

(73) Assignee: LG Electronics Inc., Seoul (KR)

( * ) Notice: Subject to any disclaimer, the term of this patent is extended or adjusted under 35 U.S.C. 154(b) by 154 days.

(21) Appl. No.: 17/666,176

(22) Filed: Feb. 7, 2022

(65) Prior Publication Data

US 2022/0251757 A1 Aug. 11, 2022

(30) Foreign Application Priority Data

Feb. 8, 2021 (KR) ..... 10-2021-0017318
Feb. 8, 2021 (KR) ..... 10-2021-0017319

(51) Int. Cl.

| | |
|---|---|
| ***D06F 58/00*** | (2020.01) |
| ***D06F 37/30*** | (2020.01) |
| ***D06F 37/20*** | (2006.01) |
| ***D06F 37/26*** | (2006.01) |

(52) U.S. Cl.
CPC ..... *D06F 37/304* (2013.01); *D06F 37/206* (2013.01); *D06F 37/261* (2013.01)

(58) Field of Classification Search
CPC ..... D06F 37/304; D06F 58/00
See application file for complete search history.

(56) References Cited

U.S. PATENT DOCUMENTS

| | | | |
|---|---|---|---|
| 4,407,078 | A | 10/1983 | Takeyama et al. |
| 2006/0005582 | A1 | 1/2006 | Lee et al. |
| 2020/0362499 | A1 | 11/2020 | Nam et al. |

FOREIGN PATENT DOCUMENTS

| | | |
|---|---|---|
| CN | 1153239 | 7/1997 |
| CN | 1888204 | 1/2007 |
| CN | 101109142 | 1/2008 |
| CN | 202214640 | 5/2012 |
| CN | 108431324 | 8/2018 |
| CN | 109252337 | 1/2019 |
| KR | 101169269 | 8/2012 |
| KR | 20200065932 | 6/2020 |
| KR | 20200066169 | 6/2020 |

OTHER PUBLICATIONS

Office Action in Chinese Appln. No. 202210112206.8, dated Apr. 13, 2023, 14 pages (with English translation).
International Search Report and Written Opinion in International Appln. No. PCT/KR2022/001595, dated May 23, 2022, 8 pages.
Extended European Search Report in European Appln. No. 22155141.9, dated Jun. 30, 2022, 9 pages.

*Primary Examiner* — Jason Y Ko
(74) *Attorney, Agent, or Firm* — Fish & Richardson P.C.

(57) ABSTRACT

Provided is a laundry treating apparatus comprising a drum including: a drum body defining a space to store laundry therein, a front cover, a rear cover, and a drum introduction opening defined at the front cover and configured to communicate with an inside of the drum body; a drying unit configured to supply heated air to the drum body; a fixing panel; a power transmission unit including: a housing, an input shaft, an output shaft, and a gear unit disposed in the housing and configured to transmit rotational motion of the input shaft to the output shaft; a motor comprising including: a stator, and a rotor; and a heat insulation part made of a material having heat conductivity lower than heat conductivity of the housing and configured to reduce an amount of heat that is transferred from the outside of the housing to an inside of the housing.

18 Claims, 13 Drawing Sheets

LAUNDRY TREATING APPARATUS

CROSS-REFERENCE TO RELATED APPLICATIONS

The present application claims the benefits of priority to Korean Patent Application Nos. 10-2021-0017318, filed on Feb. 8, 2021, and 10-2021-0017319, filed on Feb. 8, 2021, the disclosures of which are incorporated herein by reference in their entirety.

TECHNICAL FIELD

The present disclosure relates to a laundry treating apparatus.

BACKGROUND

A laundry treating apparatus may refer to a washing machine for washing laundry (e.g., an object to be washed or an object to be dried), a dryer for drying laundry, and an apparatus capable of both washing and drying laundry.

The washing machine can include a tub, which stores water therein, a washing drum, which is provided in the tub to store laundry therein, and a driving unit (e.g., a washing driving unit), which rotates the washing drum. The dryer can include a drying drum, which stores laundry therein, a driving unit (e.g., a drying driving unit), which rotates the drying drum, and a heat exchange unit, which supplies air to the drying drum to remove moisture from laundry.

The washing driving unit can include a stator, which is secured to the tub to form a rotating magnetic field, a rotor, which is rotated by the rotating magnetic field, and a rotation shaft, which passes through the tub to connect the washing drum to the rotor. The drying driving unit can include a motor, a pulley, which is secured to the rotation shaft of the motor, and a belt (e.g., a power transmission unit), which transmits the rotational motion of the pulley to the drying drum.

The washing driving unit can be configured such that the rotation shaft of the motor connects the washing drum to the rotor. In order to wash or spin-dry laundry, the washing driving unit may need to increase the rate of rotation of the washing drum or to change the rotation direction of the washing drum. When the rotation shaft of the motor directly connects the washing drum to the rotor, it is possible to easily control the rate of rotation and the rotation direction of the washing drum.

Meanwhile, the conventional drying driving unit can be structured such that a power transmission unit, such as a belt, connects the drying drum to the rotation shaft of the motor. The reason why the dryer employs a power transmission unit, such as a belt, in order to rotate the drying drum is that the rate of rotation of the drying drum does not need to be maintained particularly high and that the rotation direction of the drying drum generally does not need to be changed. However, if the dryer is designed so as to be capable of changing the rate of rotation and the rotation direction of the drying drum, movement of laundry in the drying drum may be capable of being controlled, leading to a reduction in the drying time and improvement of drying performance.

In some examples, the drying driving unit can be structured such that an input shaft, connected to the rotor, and an output shaft, connected to the drying drum, are disposed coaxially. Accordingly, it may be possible to shorten the drying time or to improve drying performance. However, heat supplied to the drying drum could be transferred to the inside of the drying driving unit, which may lead to deterioration in the durability of the drying driving unit.

SUMMARY

The present disclosure is directed to a laundry treating apparatus, which includes a power transmission unit configured to connect an input shaft, which is connected to a rotor, and an output shaft, which is connected to a drum, to each other such that the input shaft and the output shaft are disposed coaxially.

The present disclosure is also directed to a laundry treating apparatus, which is capable of minimizing the transfer of external heat to the inside of the power transmission unit, thereby minimizing deterioration in the durability of the power transmission unit.

The present disclosure is also directed to a laundry treating apparatus, which includes a means for dissipating heat in the power transmission unit to the outside, thereby minimizing deterioration in the durability of the power transmission unit.

The present disclosure is also directed to a laundry treating apparatus, which is capable of minimizing deterioration in the durability of bearings supporting the input shaft and the output shaft caused by external force acting on the input shaft and the output shaft during operation of the power transmission unit.

According to one aspect of the subject matter described in this application, a laundry treating apparatus can include a drum including a drum body defining a space to receive laundry therein, a front cover defining a front surface of the drum body, a rear cover defining a rear surface of the drum body, and a drum introduction opening defined at the front cover and configured to communicate with an inside of the drum body, a drying unit configured to supply heated air to the drum body, a fixing panel disposed at a position spaced apart from the rear cover, a power transmission unit including a housing coupled to the fixing panel, an input shaft having one end disposed at an outside of the housing and an opposite end disposed in the housing, an output shaft having one end coupled to the rear cover and an opposite end disposed in the housing, and a gear unit disposed in the housing and configured to transmit rotational motion of the input shaft to the output shaft, a motor including a stator coupled to the fixing panel or the housing and configured to form a rotating magnetic field, and a rotor configured to be rotated by the rotating magnetic field and to allow the one end of the input shaft to be coupled thereto; and a heat insulation part made of a material having heat conductivity lower than heat conductivity of the housing and configured to reduce an amount of heat that is transferred from the outside of the housing to an inside of the housing.

Implementations according to this aspect can include one or more of the following features. For example, the heat insulation part can be disposed at a surface of the housing that faces the fixing panel.

In some implementations, the housing can be coupled to the fixing panel so as to be disposed in a space isolated from a space in which the drum is located.

In some implementations, the heat insulation part can be made of a material having heat conductivity lower than heat conductivity of the fixing panel.

In some implementations, the housing can include a housing body having a hollow cylindrical shape, the housing body having an opening disposed at a surface thereof that faces the fixing panel, and a housing cover coupled to the housing body and configured to close the opening, and wherein the heat insulation part is disposed at the housing cover.

In some implementations, the housing body and the housing cover can be made of a metallic material, and the heat insulation part can be made of a non-metallic material.

In some implementations, the housing cover can include a cover body surrounding the opening, an output shaft through-hole defined at the cover body and configured to allow the output shaft to be inserted thereinto, and an output shaft support portion protruding from the cover body toward the fixing panel and surrounding the output shaft through-hole, and wherein the heat insulation part includes a cover insulation body coupled to the cover body, and a support portion insulation body surrounding a circumferential surface of the output shaft support portion.

In some implementations, the housing cover can further include a bent portion formed such that a region of the cover body in which the output shaft through-hole is defined protrudes toward the fixing panel. In some implementations, the housing cover and the cover insulation body can be formed integrally with each other.

In some implementations, the cover insulation body can include a first insulation body disposed at a surface of the cover body that faces the fixing panel in a space provided by the cover body, and a second insulation body disposed at a surface of the cover body that faces the housing body in a space provided by the cover body.

In some implementations, the laundry treating apparatus can further include a cover through-hole defined at the cover body, and a connection body inserted into the cover through-hole and connecting the first insulation body to the second insulation body.

In some implementations, the cover insulation body is coupled to the housing cover via insert injection molding.

In some implementations, the laundry treating apparatus can further include an output shaft bearing disposed inside the output shaft support portion and configured to rotatably secure the output shaft to an inside of the output shaft support portion, and a seal coupled to the output shaft support portion and configured to restrict introduction of external air into the output shaft bearing.

In some implementations, the laundry treating apparatus can further include a mounting portion provided at the cover body and configured to allow the stator to be detachably secured thereto.

In some implementations, the heat insulation part can further include a mounting portion insulation body surrounding the mounting portion.

In some implementations, the stator can include a core having a ring shape, a plurality of support bars protruding radially from an outer circumferential surface of the core, a core insulation part surrounding the core, a plurality of support bar insulation parts disposed at the core insulation part to surround respective ones of the plurality of support bars, a coil disposed at each of the plurality of support bar insulation parts, and a stator bracket disposed at an inner circumferential surface of the core insulation part so as to be coupled to the mounting portion.

In some implementations, the laundry treating apparatus can further include a bracket protrusion defined at the stator bracket, and a protrusion accommodation recess defined in the cover insulation body and configured to allow the bracket protrusion to be inserted thereinto.

According to another aspect, a laundry treating apparatus can include a drum including a drum body defining a space to store laundry therein, a front cover defining a front surface of the drum body, a rear cover defining a rear surface of the drum body, and a drum introduction opening defined at the front cover and configured to communicate with an inside of the drum body, a drying unit configured to supply heated air to the drum body, a fixing panel disposed at a position spaced apart from the rear cover, a power transmission unit including a housing coupled to the fixing panel, an input shaft having one end disposed at an outside of the housing and an opposite end disposed in the housing, an output shaft having one end coupled to the rear cover and an opposite end disposed in the housing, and a gear unit disposed in the housing and configured to transmit rotational motion of the input shaft to the output shaft, a motor including a stator coupled to the fixing panel or the housing and configured to form a rotating magnetic field, and a rotor configured to be rotated by the rotating magnetic field and to allow the one end of the input shaft to be coupled thereto; and a heat insulation part made of a material having heat conductivity lower than heat conductivity of the fixing panel and heat conductivity of the housing, the heat insulation part being disposed at a position between the housing and the fixing panel or a position between the fixing panel and the rear cover.

DETAILED DESCRIPTION

Hereinafter, implementations of a laundry treating apparatus will be described in detail with reference to the accompanying drawings.

Figure 1:
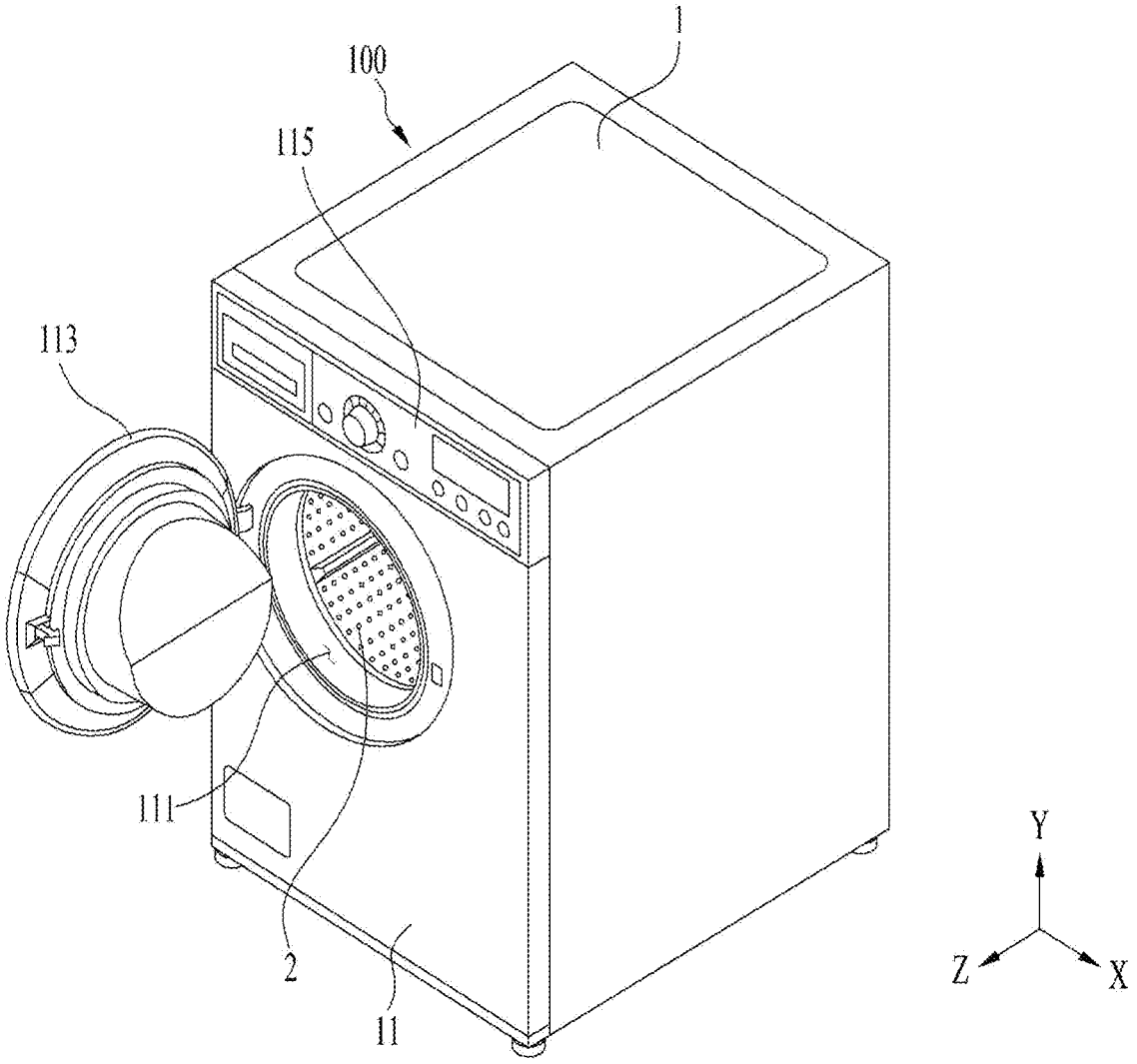
FIG. 1 is a schematic view illustrating an exemplary laundry treating apparatus.
Figure 2:
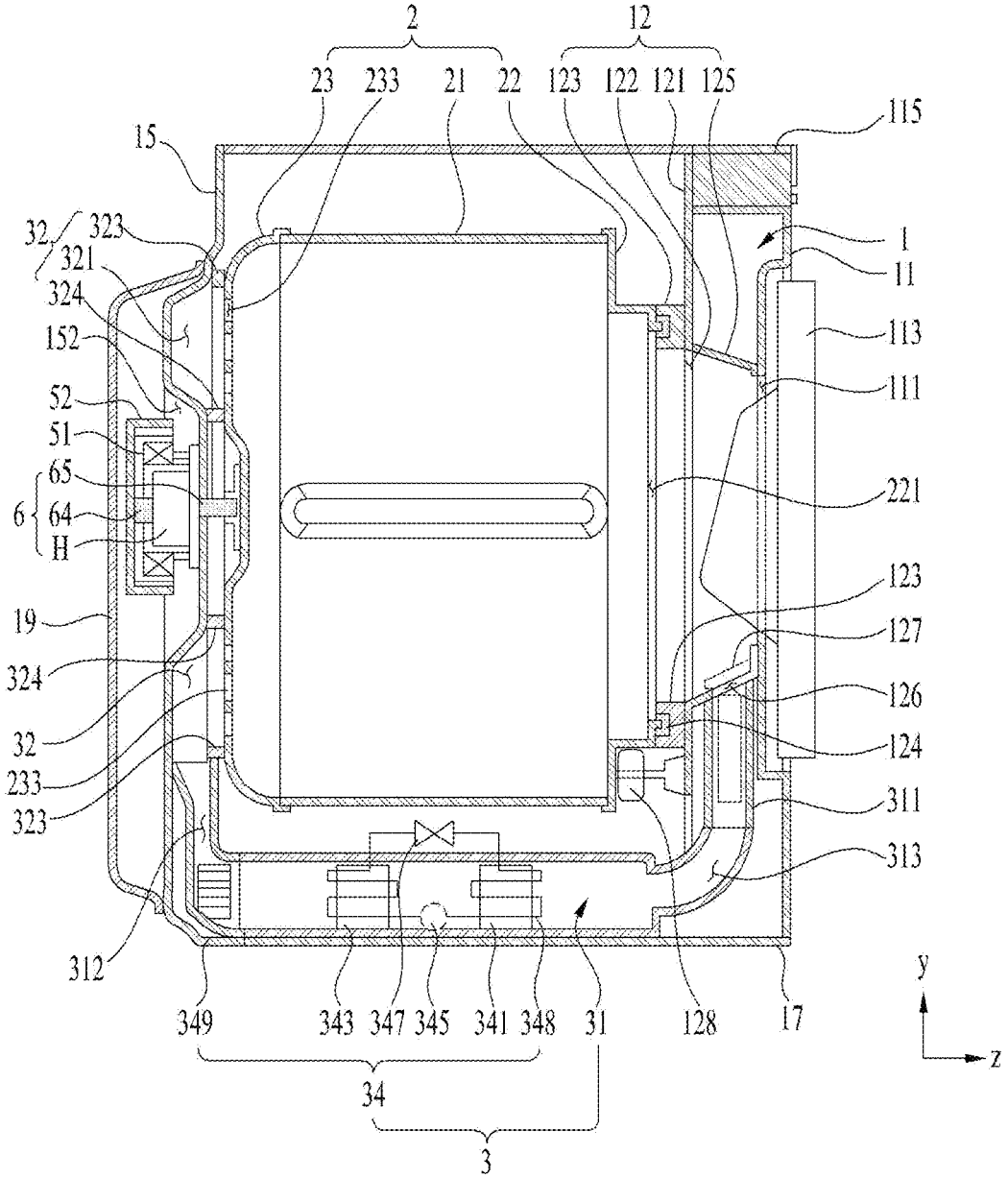
FIG. 2 is a schematic view illustrating an exemplary laundry treating apparatus.

FIG. 1 is a view illustrating an example state of a laundry treating apparatus 100. The laundry treating apparatus 100 can include a cabinet 1 and a drum 2, which is rotatably provided inside the cabinet and defines a space for storing laundry (e.g., an object to be washed or an object to be dried). As shown in FIG. 2, a drying unit 3 can be provided inside the cabinet 1 configured to remove moisture from laundry by supplying high-temperature dry air (e.g., air having a temperature higher than room temperature or air having dryness higher than the dryness of indoor air) to the drum 2.

Figure 3:
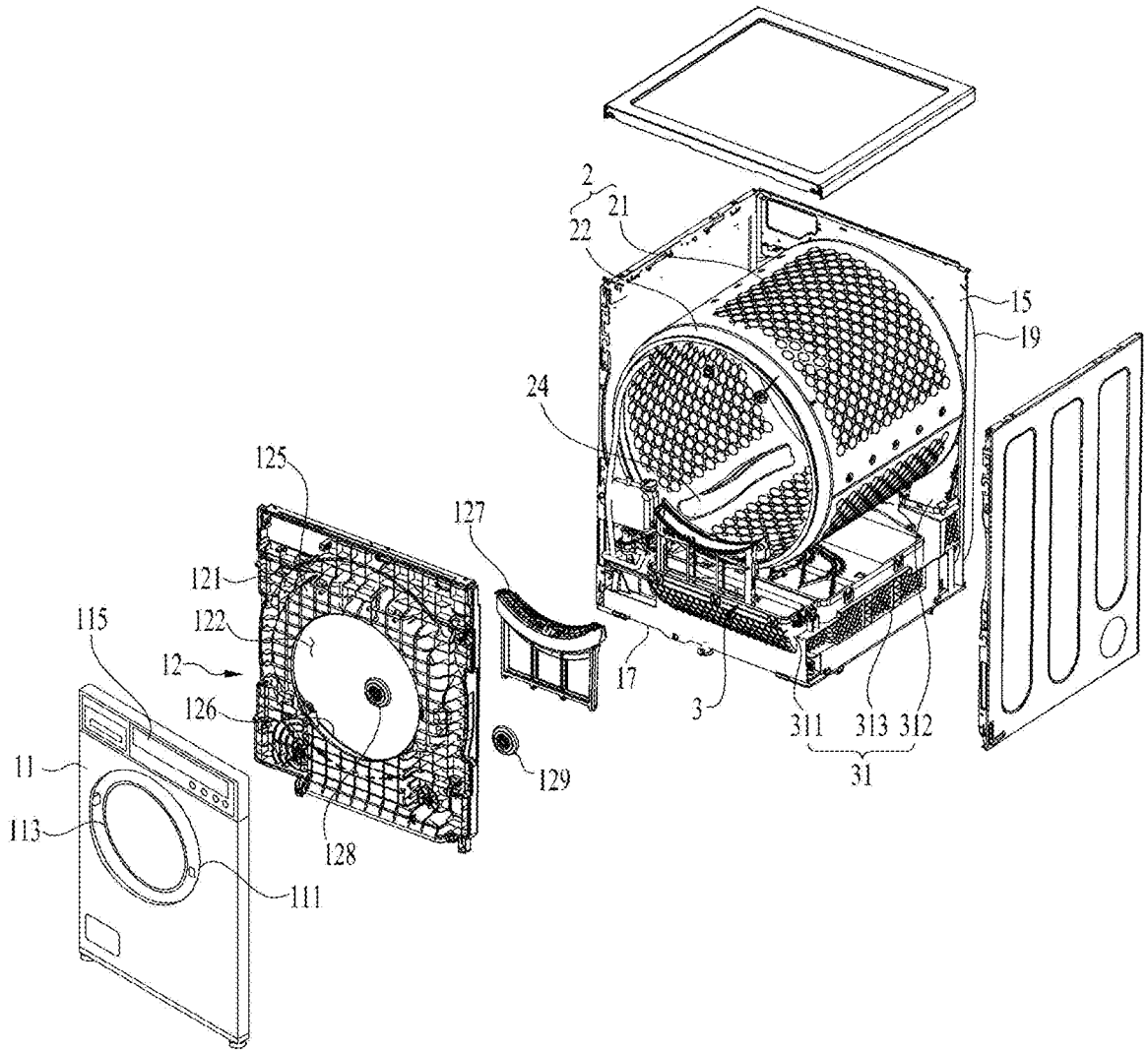
FIG. 3 is an exploded view illustrating an example state of the internal structure of the laundry treating apparatus.

As shown in FIG. 3, the cabinet 1 can include a front panel 11, which defines the front surface of the laundry treating apparatus, and a base panel 17, which defines the bottom surface of the laundry treating apparatus. The front panel 11 can include an introduction opening 111, which is configured to communicate with the drum 2. In some implementations, a door 113 is configured to close the introduction opening 111.

A control panel 115 can be disposed at the front panel 11. The control panel 115 can include an input unit configured to receive a control command from a user and a display configured to output information, such as control commands selectable by the user. The input unit can include a power supply request unit configured to request the supply of power to the laundry treating apparatus, a course input unit configured to allow the user to select a desired course from among a plurality of courses, and an execution request unit configured to request commencement of the course selected by the user.

In some implementations, the drum 2 can be formed in a hollow cylindrical shape. FIG. 2 is a view illustrating an example state of the case in which the drum 2 includes a drum body 21, which has the shape of a cylinder that has an open front surface and an open rear surface, a front cover 22, which defines the front surface of the drum body 21, and a rear cover 23, which defines the rear surface of the drum body 21. The front cover 22 can include a drum introduction opening 221 configured to communicate the inside of the drum body 21 with the outside of the drum body, and the rear cover 23 can include an air inlet 233 configured to allow external air to flow into the drum body 21.

As shown in FIG. 3, the drum body 21 can further include a lifter 24. In some implementations, the lifter 24 can be formed such that a board, which extends from the front cover 22 toward the rear cover 23, protrudes from the drum body 21 toward the rotation center of the drum 2. In some implementations, the board protrudes from the circumferential surface of the drum toward the rotation center of the drum.

In the laundry treating apparatus 100, the drum 2 can have a drum through-hole disposed at the drum body 21 and configured to communicate the inside of the drum with the outside of the drum. However, in some implementations, when the laundry treating apparatus 100 is configured as a laundry drying apparatus, the drum 2 may not have a drum through-hole therein.

The drum 2 can be rotatably coupled to at least one of a first body support part 12 or a second body support part 15. In some implementations, the rear cover 23 is rotatably coupled to the second body support part 15 via a motor 5 (e.g., a driving unit) and the front cover 22 is rotatably coupled to the first body support part 12.

The first body support part 12 can define a support panel 121, which is coupled to the cabinet 1 and is disposed between the front panel 11 and the front cover 22. The support panel 121 can be coupled to the base panel 17, and can be disposed between the front panel 11 and the front cover 22. In some implementations, the rear surface of the front panel 11 (the surface facing the support panel) can be coupled to the support panel 121, and the lower end thereof can be coupled to the base panel 17.

In some implementations, the support panel 121 can include a support panel through-hole 122, a drum connection body 123 coupling the support panel through-hole 122 to the drum introduction opening 221, and a panel connection body 125 coupling the support panel through-hole 122 to the introduction opening 111. The support panel through-hole 122 can be defined at the support panel 121 and configured to communicate the introduction opening 111 with the drum introduction opening 221.

As shown in FIG. 2, the drum connection body 123 can be formed as a pipe that is coupled to the rear surface of the support panel 121 (the surface facing the drum introduction opening in the space provided by the support panel). One end of the drum connection body 123 can be formed so as to surround the support panel through-hole 122, and the free end of the drum connection body 123 can be formed so as to support the front cover 22. In some implementations, the free end of the drum connection body 123 can be inserted into the drum introduction opening 221, or can be in contact with the free end of the front cover 22, which forms the drum introduction opening 221.

In some implementations, the free end of the drum connection body 123 can be in contact with the free end of the front cover 22. In this case, the drum connection body 123 can be provided with a ring-shaped connection damper 124. The connection damper 124 can be configured to minimize the risk of separation of the drum introduction opening 221 from the drum connection body 123 (the risk of leakage of air in the drum to the cabinet) when the drum 2 rotates or vibrates.

The panel connection body 125 can be formed as a pipe that is coupled to the front surface of the support panel 121 (the surface facing the front panel in the space provided by the support panel). One end of the panel connection body 125 can be formed so as to surround the support panel through-hole 122, and the other end of the panel connection body 125 may be formed so as to be couple to the introduction opening 111. In some implementations, the laundry supplied to the introduction opening 111 can move to the drum body 21 through the panel connection body 125, the support panel through-hole 122, the drum connection body 123, and the drum introduction opening 221.

The support panel 121 can include an exhaust port 126, which can be defined at the panel connection body 125, and a filter 127 can be detachably coupled to the exhaust port 126. In some implementations, the filter 127 can be disposed at any of various structures, and configured to remove foreign substances from the air moving from the drum 2 to the exhaust port 126.

The support panel 121 can be further provided with drum support parts 128 and 129 and configured to prevent the drum 2 from sagging. The drum support parts can include a first roller 128 and a second roller 129, which are coupled to the support panel 121 and configured to rotatably support the drum 2. In some implementations, the first roller 128 and the second roller 129 can support the drum body 21, and the rollers 128 and 129 can support the front cover 22.

The second body support part 15 can include a fixing panel 151, which can be coupled to the cabinet 1 and located at a point spaced apart from the rear cover 23. In some implementations, the fixing panel 151 can be coupled to the base panel 17 defining the rear surface of the laundry treating apparatus 100 (the rear surface of the cabinet).

The fixing panel 151 can include a driving-unit-mounting recess 152, defining a space in which the motor 5 is mounted. The driving-unit-mounting recess 152 can be defined such that a portion of the fixing panel 151 is concavely depressed toward the rear cover 23 of the drum. The fixing panel 151 can include a fixing panel through-hole 153 formed therein configured to allow a shaft (an output shaft) for rotating the drum 2 to pass therethrough. The fixing panel through-hole 153 can be disposed at the driving-unit-mounting recess 152.

In some implementations, when the drum 2 include the drum body 21, the front cover 22 coupled to the drum body, and the rear cover 23 coupled to the drum body, the rigidity of the drum can be higher than that of a structure in which the open front surface and the open rear surface of the drum body 21 are rotatably coupled to the support panel 121 and the fixing panel 151, respectively. The increase in the rigidity of the drum can minimize deformation of the drum body 21 during rotation of the drum, thus minimizing a problem in which laundry gets caught in the space between the drum body and the support panel or in the space between the drum body and the fixing panel due to deformation of the drum body 21 (thereby minimizing the load on the motor).

As shown in FIG. 2, the drying unit 3 can include an exhaust passage 31, which is coupled to the exhaust port 126, a supply passage 32 configured to guide the air in the exhaust passage 31 to the drum body 21, and a heat exchange unit 34, which is provided inside the exhaust passage 31 and configured to sequentially dehumidify and heat air.

The exhaust passage 31 can include a first duct 311, which is coupled to the exhaust port 126, a second duct 312, which is coupled to the supply passage 32, and a third duct 313, which couples the first duct 311 to the second duct 312. In some implementations, the third duct 313 can be secured to the base panel 17.

The heat exchange unit 34 can be implemented as any of various devices, so long as the device is capable of sequentially dehumidifying and heating the air introduced into the exhaust passage 31. In some implementations, the heat exchange unit 34 can be implemented as a heat pump. In some implementations, the heat exchange unit 34 can include a first heat exchanger 341 (a heat-absorbing part) configured to remove moisture from the air introduced into the exhaust passage 31, a second heat exchanger 343 (a heat-generating part), which is provided inside the exhaust passage 31 and configured to heat the air that has passed through the heat-absorbing part 341, and a fan 349 configured to move the discharge air from the drum 2 to sequentially pass through the heat-absorbing part and the heat-generating part and then to the supply duct 32.

In some implementations, the heat-absorbing part 341 and the heat-generating part 343 can be sequentially disposed in the direction in which air flows, and can be connected to each other via a refrigerant pipe 348, which forms a circulation path of the refrigerant. A compressor 345 can be disposed outside the exhaust passage 31 and configured to move the refrigerant along the refrigerant pipe 348, and the refrigerant pipe 348 can include a pressure regulator 347 configured to control the pressure of the refrigerant.

Figure 4:
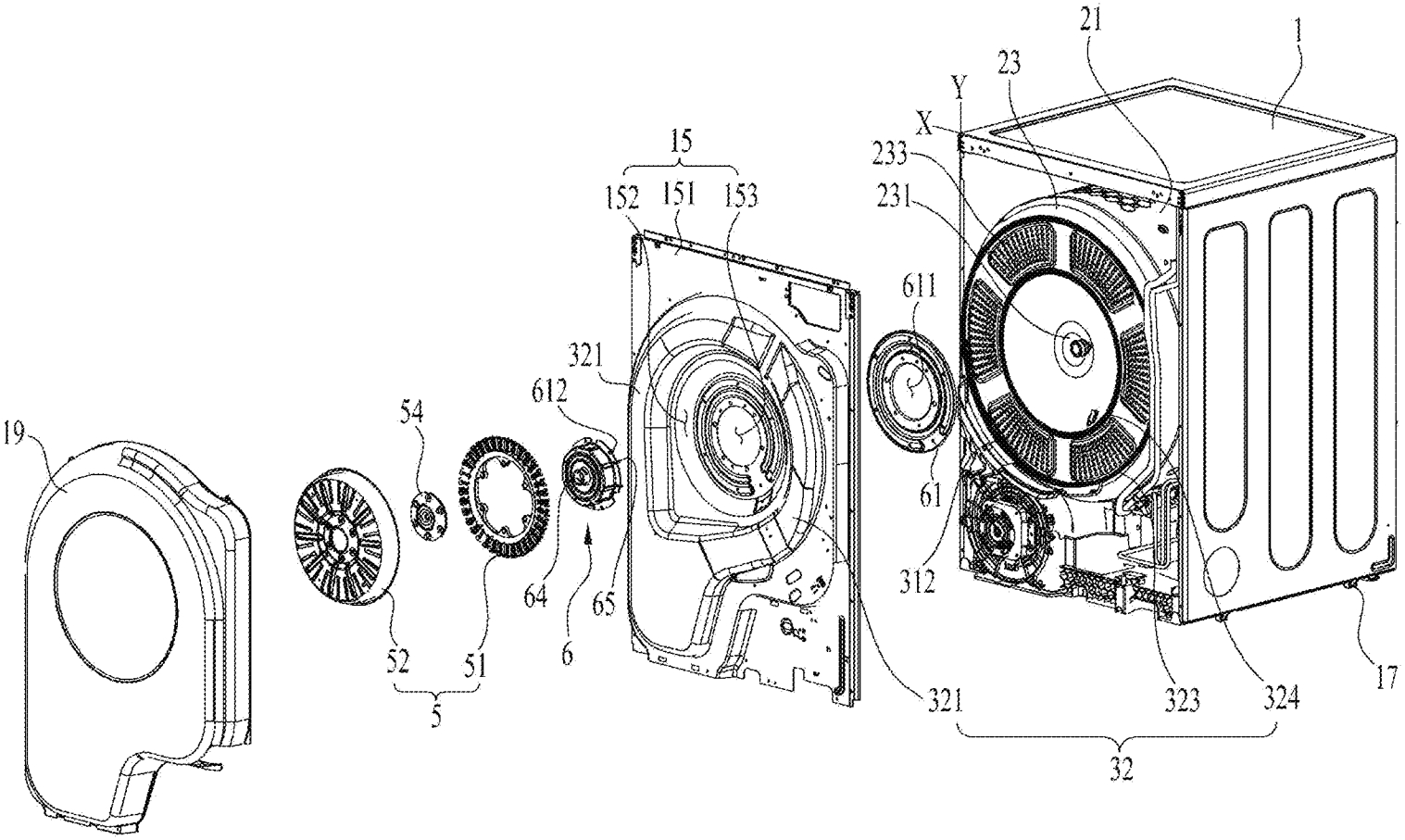
FIG. 4 is an exploded view illustrating an example state of the internal structure of the laundry treating apparatus.

As shown in FIG. 4, the air inlet 233 defined at the rear cover 23 of the drum, can include a plurality of holes, which are disposed around the center of the rear cover 23 (the rotation center of the drum). In some implementations, the supply passage 32 can include a supply duct 321 disposed at the fixing panel 151, wherein the supply passage is configured to move the air discharged from the second duct 312, and a first passage-forming part 323 and a second passage-forming part 324, configured to guide the air in the supply duct 321 to the air inlet 233.

The supply duct 321 can be formed such that a portion of the fixing panel 151 is bent in a direction away from the rear cover 23 to form a passage (an air movement passage). In some implementations, the supply duct 321 can have the shape of a ring that surrounds the driving-unit-mounting recess 152, and the second duct 312 can be coupled to the circumferential surface of the supply duct 321.

The first passage-forming part 323 can be provided so as to surround the outer circumferential surface of the ring formed by the holes of the air inlet 233, and the second passage-forming part 324 can be provided so as to surround the inner circumferential surface of the ring formed by the holes of the air inlet 233.

The first passage-forming part 323 and the second passage-forming part 324 can be coupled to the rear cover 23, or can be coupled to the supply duct 321. In some implementations, the passage-forming parts 323 and 324 are coupled to the rear cover 23. In some implementations, the free end of the first passage-forming part 323 surrounds the outer circumferential surface of the passage (the ring-shaped passage) formed by the supply duct 321, and the free end of the second passage-forming part 324 surrounds the inner circumferential surface of the passage formed by the supply duct 321. The first passage-forming part 323 and the second passage-forming part 324 can be made of rubber, felt, or the like.

The motor 5 configured to rotate the drum 2 can include a stator 51, which is disposed in the driving-unit-mounting recess 152 and configured to form a rotating magnetic field, and a rotor 52 configured to be rotated by the rotating magnetic field. The rotational motion of the rotor 52 can be transmitted to the drum 2 via a power transmission unit 6, which is coupled to the fixing panel 151, and the stator 51 can be coupled to at least one of the fixing panel 151 or the power transmission unit 6. In some implementations, the structure in which the stator 51 is coupled to the power transmission unit 6 can be advantageous from the aspect of maintenance of coaxiality between an input shaft 64 and an output shaft 65, which are included in the power transmission unit 6 (consequently minimizing vibration of the laundry treating apparatus during rotation of the drum and minimizing deterioration in the durability of the power transmission unit).

In order to prevent the motor 5, which is provided in the driving-unit-mounting recess 152, from being exposed to the outside (in order to improve the durability of the motor and to prevent accidents by preventing the motor from being exposed to the external environment), the fixing panel 151 can further include a cover panel 19 configured to prevent the motor 5 from being exposed to the outside. In some implementations, the cover panel 19 can be formed in a shape that surrounds the supply duct and configured to prevent the supply duct 321 from being exposed to the outside. The reason for this is not only to minimize radiation of heat to the outside of the supply duct 321, but also to prevent an accident, which may be caused by contact of the user's body with the supply duct 321.

Figure 5:
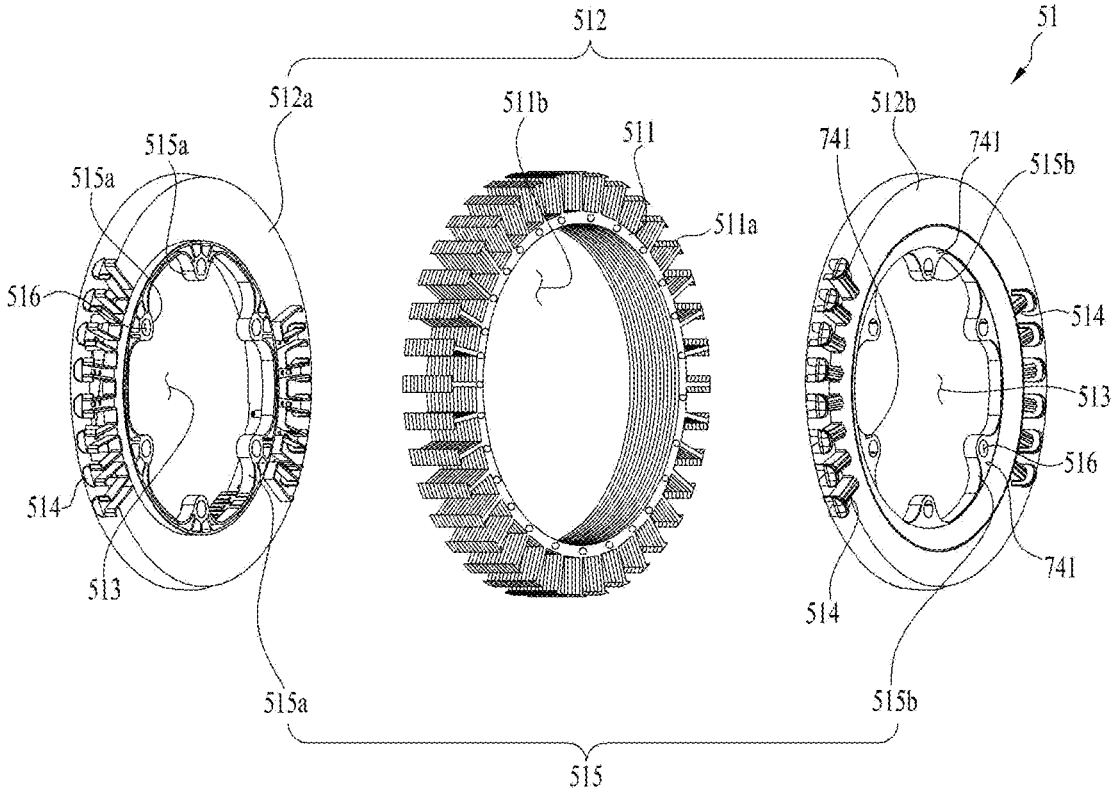
FIG. 5 is a schematic view illustrating an example state of a stator.

As shown in FIG. 5, the stator 51 can include a core 511 (e.g., a ring-shaped core), which has a through-hole **511*b* (e.g., a core through-hole) defined at the center thereof, a plurality of support bars 511*a*, which protrude radially from the outer circumferential surface of the core 511, a core insulation part 512, which is configured to insulate the core and has a ring shape, a plurality of support bar insulation parts 514, which are disposed at the core insulation part 512 to surround the support bars, and coils, which are disposed at the support bar insulation parts 514**.

The core insulation part 512 can be formed in the shape of a ring that has an insulation part through-hole 513 defined at the center thereof defining a space in which the core 511 is accommodated. In some implementations, the core insulation part 512 can include a first insulation body **512*a* and a second insulation body 512*b*. In this case, the support bar insulation parts 514 can include first support bar insulation parts, which are provided in the first insulation body 512*a*, and second support bar insulation parts, which are provided in the second insulation body 512*b***.

The core insulation part 512 can include a stator bracket 515. The stator bracket 515 can include a plurality of brackets, which protrude from the inner circumferential surface of the core insulation part 512 toward the center of the insulation part through-hole 513. In some implementations, when the core insulation part 512 includes the first insulation body 512*a* and the second insulation body 512*b*, the stator bracket 515 can include first brackets 515*a*, which are provided in the first insulation body, and second brackets 515*b*, which are provided in the second insulation body and are coupled to the first brackets 515*a*.

The stator bracket 515 can be coupled to the power transmission unit 6 using a stator coupling part such as a bolt. In some implementations, the stator bracket 515 can have a coupling part through-hole 516 defined therein.

Figure 6:
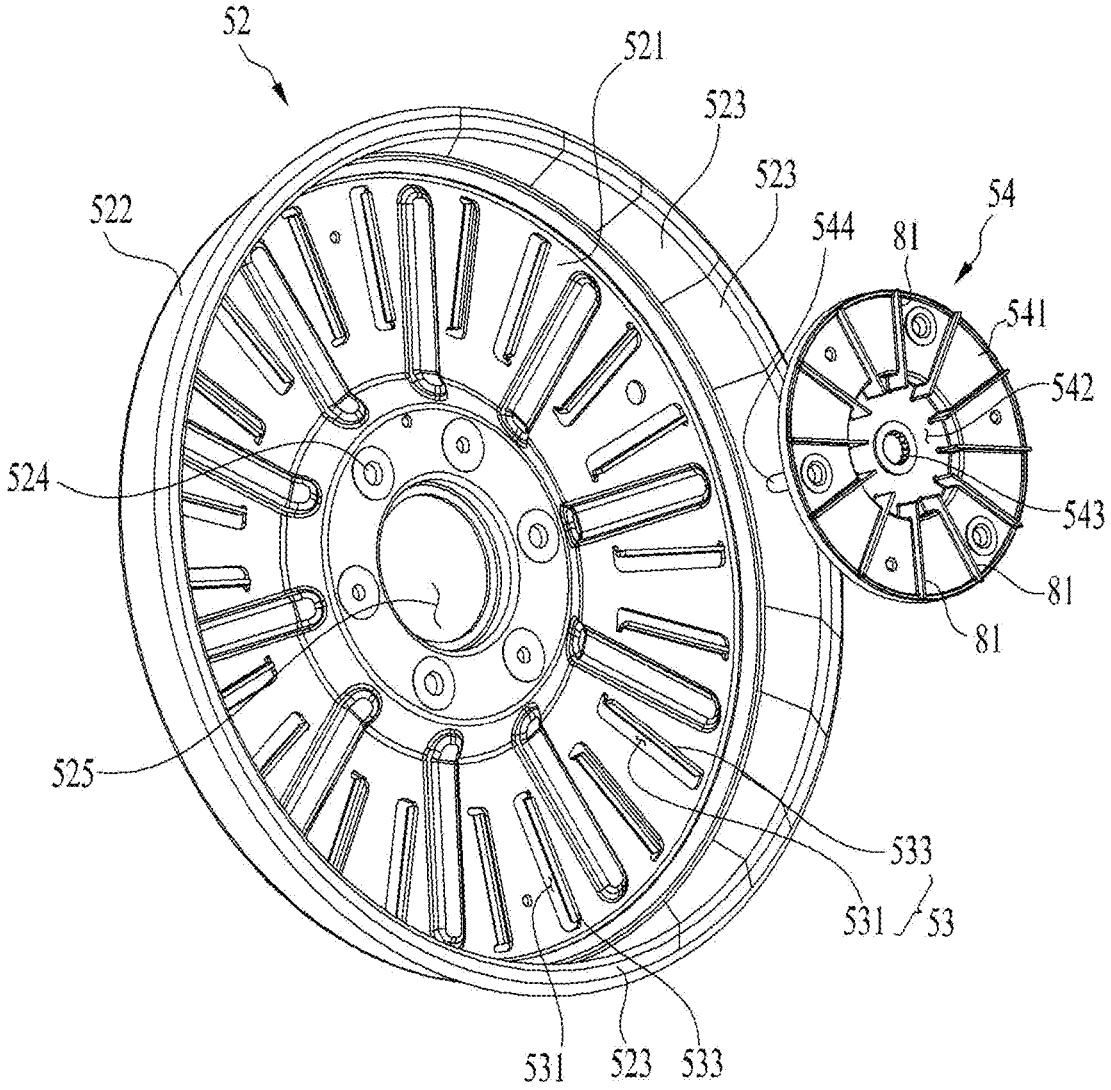
FIG. 6 is a schematic view illustrating an example state of a rotor.

As shown in FIG. 6, the rotor 52 can include a rotor body 521, a rotor circumferential surface 522, which extends from the edge of the rotor body 521 toward the fixing panel 515 defining a space in which the stator 51 is accommodated, and a plurality of permanent magnets 523, which are coupled to the rotor circumferential surface 522 such that N-poles and S-poles thereof are alternately exposed.

The motor 5 can further include a motor heat dissipation part 53 configured to dissipate the heat generated from the stator 51 to the outside of the rotor 52. The motor heat dissipation part 53 can include a plurality of rotor through-holes 531, which are defined at the rotor body 521, and a plurality of rotor blades 533, which are provided at the rotor body 521 and configured to form airflow for inducing the air in the rotor to move to the rotor through-holes 531.

In some implementations, each rotor through-hole 531 can be defined as a slit that extends from the center of the rotor body 521 toward the rotor circumferential surface 522, and each rotor blade 533 can be formed as a plate that protrudes from the rotor body 521 toward the fixing panel 151. In some implementations, it is desirable for each rotor blade 533 to extend from the center of the rotor body 521 toward the rotor circumferential surface 522. The rotor through-holes 531, each of which is formed as a slit, can be radially disposed at the center of the rotor body 521 (e.g., the input shaft), and each of the rotor blades 533 can be coupled to the edge of a respective one of the rotor through-holes 531.

Figure 7:
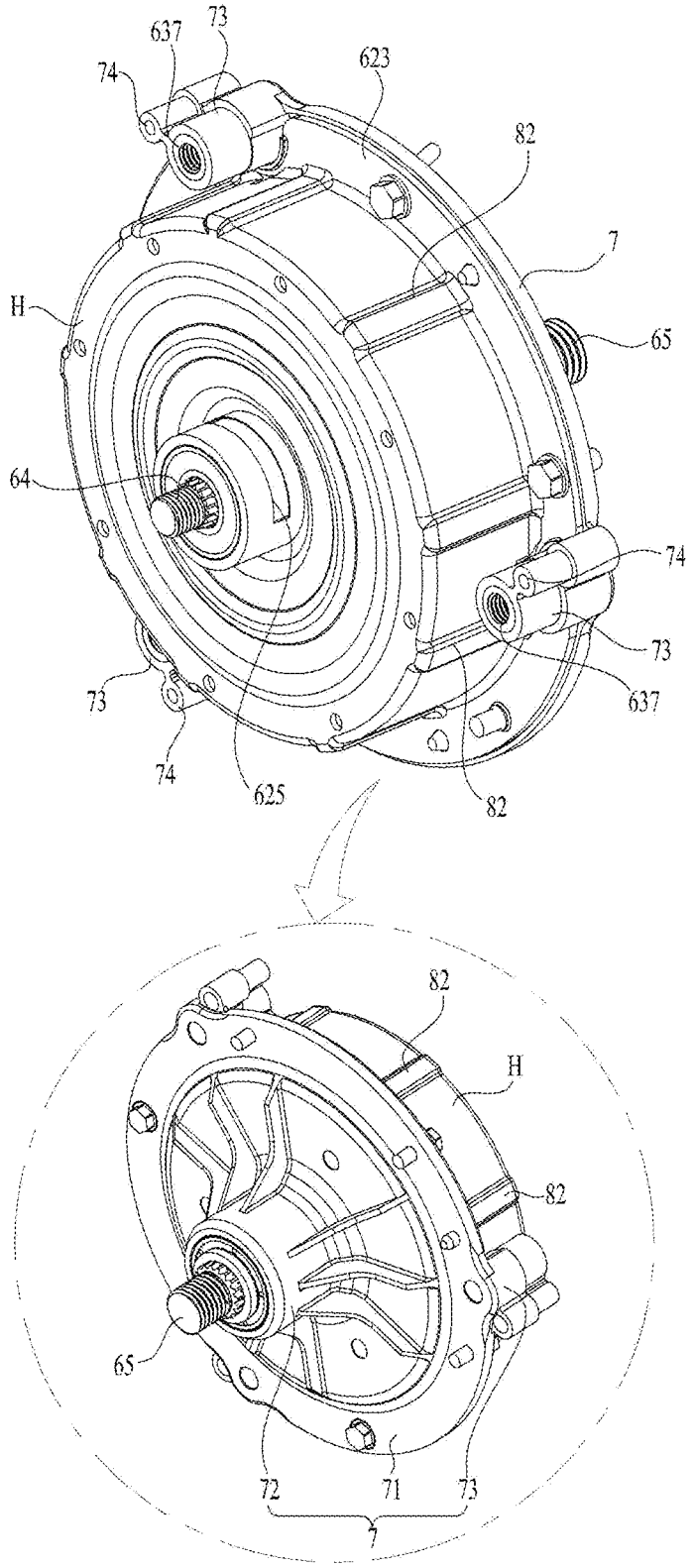
FIGS. 7 to 10 are schematic views illustrating an example state of a power transmission unit.

FIG. 7 is a view illustrating an example state of the power transmission unit 6. The power transmission unit 6 can include a housing H, which is coupled to the fixing panel 151, an input shaft 64, which is rotatably coupled to the bottom surface of the housing H (the surface oriented in a direction toward the rotor), an output shaft 65, which is rotatably coupled to the upper surface of the housing H (the surface oriented in a direction toward the fixing panel), and a gear unit, which is provided inside the housing and configured to transmit the rotational motion of the input shaft 64 to the output shaft 65. The input shaft 64 can be formed as a shaft that has one end coupled to the rotor 52 and an opposite end located inside the housing H, and the output shaft 65 may be formed as a shaft that has one end coupled to the rear cover 23 and an opposite end located inside the housing H.

In some implementations, the housing H can be couple to the fixing panel 151 and disposed in the space (the external space of the cabinet) isolated from the space in which the drum 2 is located (the internal space in the cabinet). The reason for this is to minimize the transfer of heat in the cabinet (heat radiated from the drum or the drying unit) to the inside of the housing H to thus improve the durability of the power transmission unit 6.

In some implementations, the input shaft 64 can be coupled to the rotor body 521 using the shaft coupling part 54. The shaft coupling part 54 can include a disc-shaped coupling body 541 and a shaft coupling hole 543, which is defined at the coupling body to allow one end of the input shaft 64 to be coupled thereto.

In some implementations, the coupling body 541 can include a body protrusion 544, and the rotor body 521 can have a body protrusion through-hole 524 defined therein configured to allow the body protrusion 544 to be inserted thereinto.

In some implementations, in order to increase the strength of the coupling body 541, the coupling body 541 can include a coupling body bent portion 542. The coupling body bent portion 542 can be formed such that the surface of the coupling body 541 that faces the housing H is concavely bent toward the rotor body 521. In some implementations, the rotor body 521 can have a bent portion through-hole 525 defined therein configured to allow the coupling body bent portion 542 to pass therethrough.

In some implementations, the output shaft 65 can be inserted into the fixing panel through-hole 153 to be coupled to the drum 2, and the rear cover 23 can include a shaft bracket 231, to which the output shaft 65 is secured. In some implementations, the reason for this is to disperse the stress applied to the center of the rear cover 23 during rotation of the output shaft 65.

In order to prevent sagging of the housing H and to minimize deformation of the driving-unit-mounting recess 152, the housing H can be coupled to the fixing panel 151 using a transmission unit bracket 61 and a housing coupling part 612.

As shown in FIG. 4, the transmission unit bracket 61 can have a bracket through-hole 611 configured to allow the output shaft 65 to pass therethrough, and the housing coupling part 612 can be formed as a bolt that couples the housing H to the transmission unit bracket 61. The transmission unit bracket 61 can be made of the same material as the fixing panel 151, or can be made of a material having strength higher than the strength of the fixing panel 151.

In some implementations, the transmission unit bracket 61 can be coupled to the surface of the fixing panel 151 that faces the rear cover 23. In some implementations, the transmission unit bracket 61 can be secured to the surface facing the cover panel 19 in the space defined by the fixing panel 151.

Figure 8:
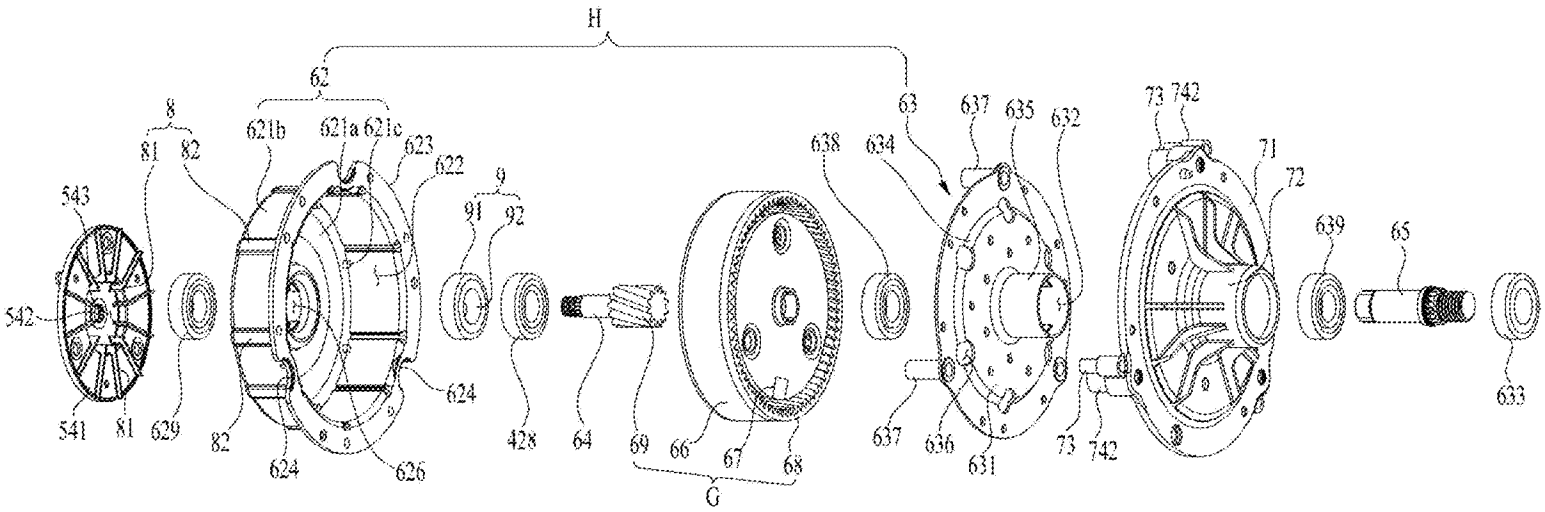

As shown in FIG. 8, the housing H can include a housing body 62, which is formed in a hollow cylindrical shape and defines an opening formed in the surface thereof that faces the fixing panel 151, and a housing cover 63, which is coupled to the housing body 62 and configured to close the opening.

The housing body 62 can define an accommodation space 622 in which the gear unit G is mounted. In some implementations, the accommodation space 622 is configured to communicate with the outside through the opening. The accommodation space 622 can be defined by a housing base 621*a*, to which the input shaft 64 is coupled, and a housing circumferential surface 621*b*, which extends from the edge of the housing base 621*a* toward the housing cover 63.

Figure 9:
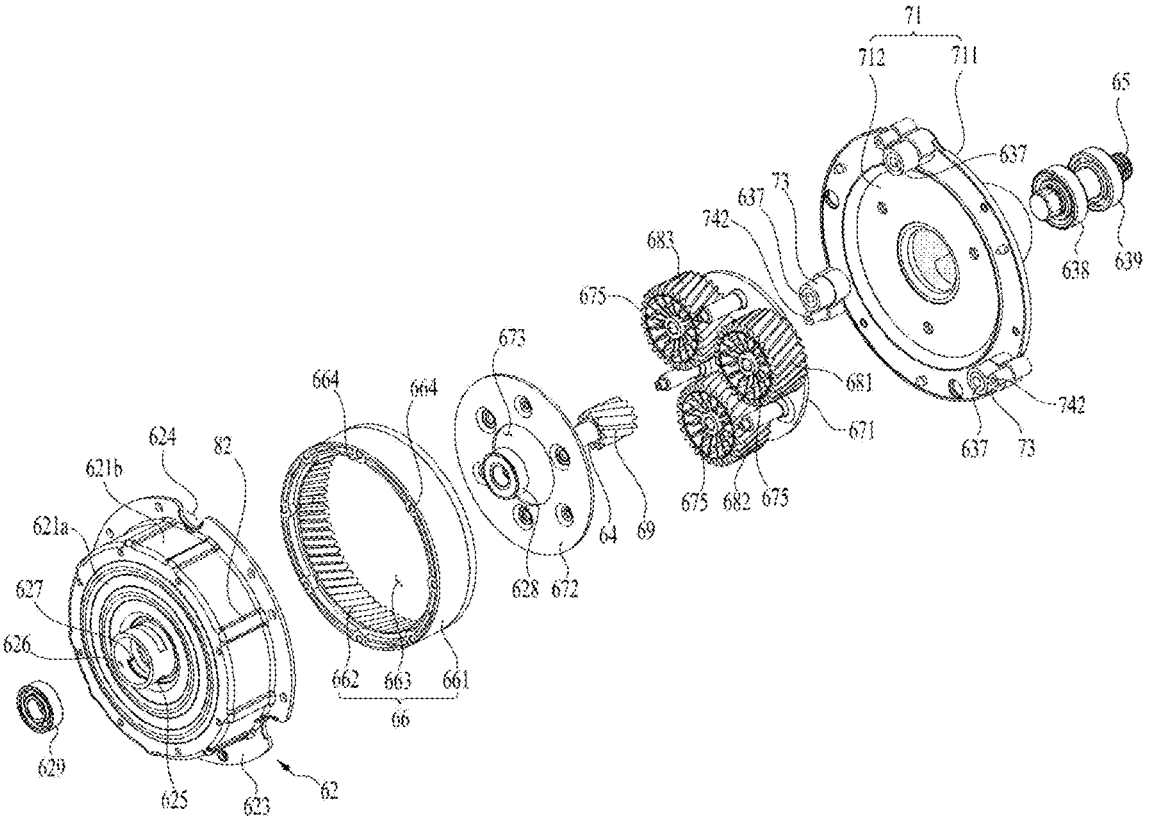

As shown in FIG. 9, the housing body 62 can include an input shaft support portion 625, which extends from the housing base 621*a* toward the rotor 52. The input shaft support portion 625 can be formed as a pipe that surrounds an input shaft through-hole 626 defined at the housing body 62. In some implementations, the input shaft through-hole

626 can be defined at the input shaft support portion 625 and configured to communicate with the accommodation space 622.

In some implementations, the input shaft 64 inserted into the input shaft through-hole 626 can be rotatably coupled to the input shaft support portion 625 using input shaft bearings 628 and 629. The input shaft bearings can include a first input shaft bearing 628 and a second input shaft bearing 629, which is fixed in the input shaft through-hole 626 so as to be located between the first input shaft bearing 628 and the rotor 52.

The free end of the input shaft support portion 625 can be inserted into the coupling body bent portion 542, which is provided at the shaft coupling part 54. In some implementations, the length of the input shaft support portion 625 may need to be increased in order to couple the two input shaft bearings 628 and 629. However, since the free end of the input shaft support portion 625 can be inserted into the coupling body bent portion 542, it is possible to minimize the amount of space that is required for installation of the motor 5 and the power transmission unit 6 (thereby minimizing the volume of the laundry treating apparatus).

The housing cover 63 can be formed in any of various shapes, so long as the same is capable of opening or closing the opening defined at the housing body 62. In some implementations, the housing cover 63 can be implemented as a disc-shaped cover body 631. The housing cover 63 can be coupled to the housing body 62 using a cover-fixing plate 623, which is defined at the housing circumferential surface 621*b*.

The housing cover 63 can include an output shaft support portion 635, which extends from the cover body 631 toward the fixing panel 151, an output shaft through-hole 632, which is defined at the output shaft support portion 635 and configured to allow the output shaft 65 to be inserted thereinto, and output shaft bearings 638 and 639, which are disposed at the output shaft support portion 635 and configured to rotatably couple the output shaft 65 to the output shaft through-hole 632.

The housing cover 63 can include a mounting portion 637, which is provided at the cover body 631 and to which the stator 51 is secured. In some implementations, the mounting portion 637 can be formed in any of various shapes that allow the stator coupling part (the bolt or the like) to be coupled thereto. In some implementations, the mounting portion 637 can be formed in a hollow cylindrical shape.

The mounting portion 637 can be provided in a plural number, and the plurality of mounting portions 637 can be disposed at the circumferential surface of the cover body 631. In some implementations, the stator bracket 515 can be provided in the same number as the number of mounting portions 637.

When the mounting portions 637 are formed in the shape of a cylinder that protrudes from the cover body 631 toward the rotor 52, it is desirable for the cover-fixing plate 623 to include fixing plate through-holes 624 defined therein and configured to allow the mounting portions 637 to be inserted thereinto. The reason for this is to minimize the outer diameter of the cover-fixing plate 623 (thereby minimizing the amount of space that is required for installation of the housing).

In order to increase the strength of the housing cover 63, the cover body 631 can include a bent portion 634, which is formed such that a region including the output shaft through-hole 632 protrudes toward the fixing panel 151.

The output shaft bearings can include a first output shaft bearing 638 and a second output shaft bearing 639, which are coupled to the output shaft support portion 635 and are disposed at the output shaft through-hole 631. In some implementations, in order to prevent external air from being supplied to the output shaft bearings 638 and 639, the housing cover 63 can further include a seal 633, which is coupled to the output shaft support portion 635 and configured to close the output shaft through-hole 632.

The housing H can be coupled to the fixing panel 151 via the housing coupling part 612. The stator 51 can be coupled to the housing H by coupling the stator coupling part, which can be inserted into the coupling part through-hole 516, to the mounting portion 637. The rotor 52 can be coupled to the housing H using the input shaft 64. In some implementations, since the stator 51 and the rotor 52 are couple to the housing H (since the stator and the rotor vibrate together with the housing), it is possible to minimize deterioration in coaxiality between the input shaft 64 and the output shaft 65.

The gear unit G can include a ring gear 66, which is coupled to the housing circumferential surface 621*b* and is disposed at the accommodation space 622, a driving gear 69, which is coupled to the input shaft 64 and is disposed at the accommodation space 622, a cage 67, which is disposed at the accommodation space 622 and to which the opposite end of the output shaft 65 is coupled, and a driven gear 68, which can be rotatably coupled to the case 67 and configured to couple the driving gear 69 to the ring gear 66.

As shown in FIG. 9, the ring gear 66 can include a gear body 661, which is coupled to the housing circumferential surface 621*b*, and gear teeth 662, which are disposed at the inner circumferential surface of the gear body.

The cage 67 can include a first base 671, which can be disposed at a gear body through-hole 663 (a through-hole defined by the gear teeth) defined at the gear body and to which one end of the output shaft 65 is coupled, a second base 672, which can be disposed at the gear body through-hole 663 and has a base through-hole 673 defined at the center thereof, and a connection shaft 675, which couples the first base to the second base and configured to serve as a rotation shaft of the driven gear 68. In some implementations, since the output shaft 65 is coupled to the first base 671, the output shaft is configured to rotate, based on the cage 67 rotating.

The driven gear 68 can include a plurality of gears. In some implementations, the driven gear can include a first driven gear 681, a second driven gear 682, and a third driven gear 683. The input shaft 64 can be inserted into the base through-hole 673, and can be disposed coaxially with the output shaft 65. The gear teeth of the driving gear 69 can be disposed in the space formed between the driven gears 681, 682, and 683 so as to be engaged with the gear teeth of the driven gears 681, 682, and 683.

In some implementations, the gear body 661 can have a coupling protrusion accommodation recess 664 defined therein, and the housing base 621*a* can include a ring gear coupling protrusion 621*c*, which can be inserted into the coupling protrusion accommodation recess 664.

In some implementations, the housing H can further include a heat insulation part 7. In some implementations, the heat insulation part 7 is configured to minimize the transfer of external heat to the accommodation space 622 in the housing, and is preferably made of a material having heat conductivity lower than the heat conductivity of the housing H. That is, when the housing body 62 and the housing cover 63 are made of a metallic material, it is desirable for the heat insulation part 7 to be made of a non-metallic material such as plastic.

When the housing H is coupled to the fixing panel 151 and is disposed at the external space of the cabinet, it is desirable for the heat insulation part 7 to be made of a material having heat conductivity lower than the heat conductivity of the fixing panel 151.

The heat insulation part 7 may be provided so as to surround the entire area of the housing H, or may be provided only in the region of the housing H that faces the fixing panel 151. In some implementations, the heat insulation part 7 can be disposed only at the housing cover 63 (the region facing the fixing panel).

Figure 11:
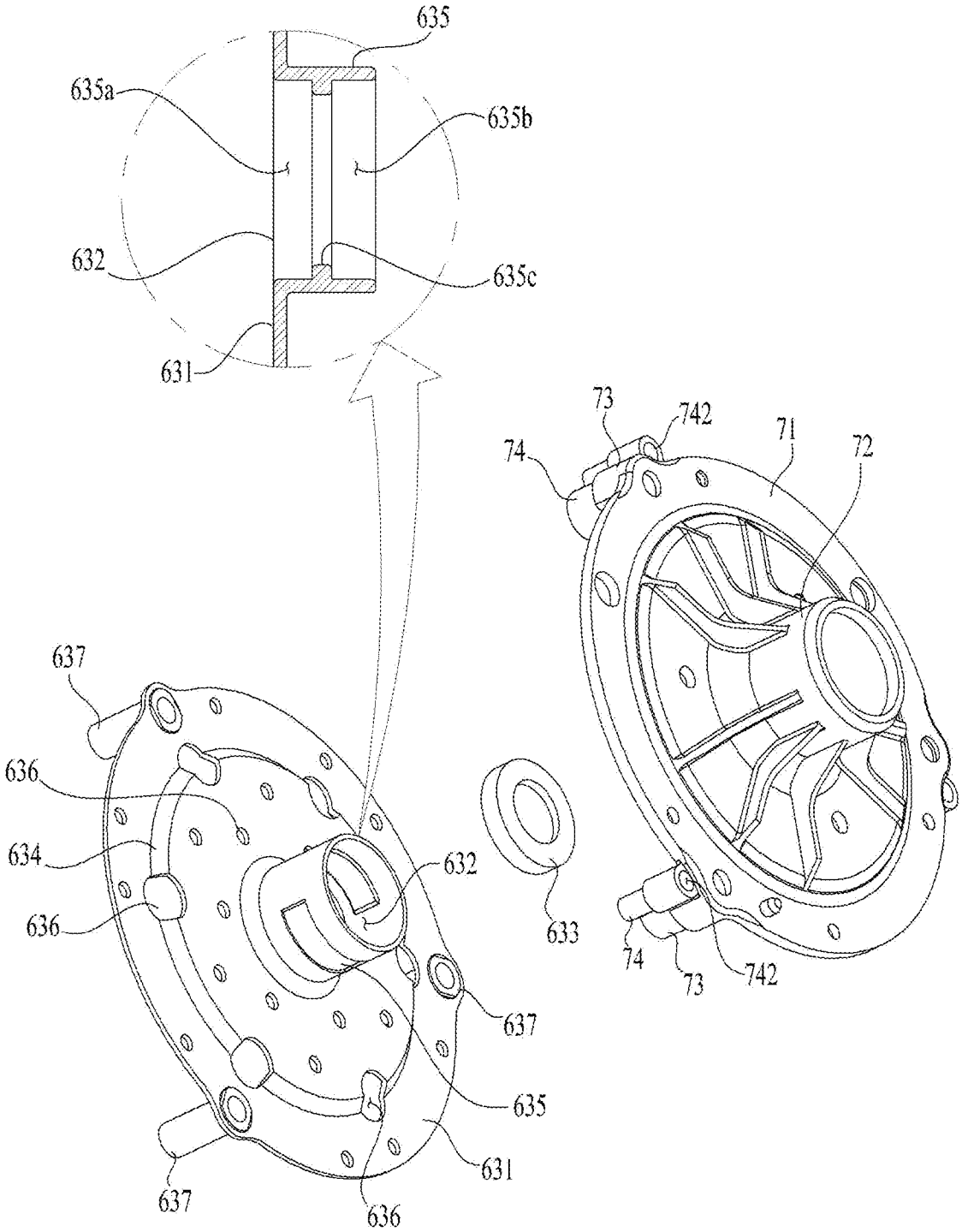
FIG. 11 is a schematic view illustrating an example state of a heat insulation part.

As shown in FIG. 11, the heat insulation part 7 can be formed integrally with the housing cover 631. In some implementations, the heat insulation part 7 and the housing cover 63 can be formed through insert injection molding in which a melted material (plastic or the like) is injected into a mold in which the housing cover 63 is accommodated.

Figure 10:
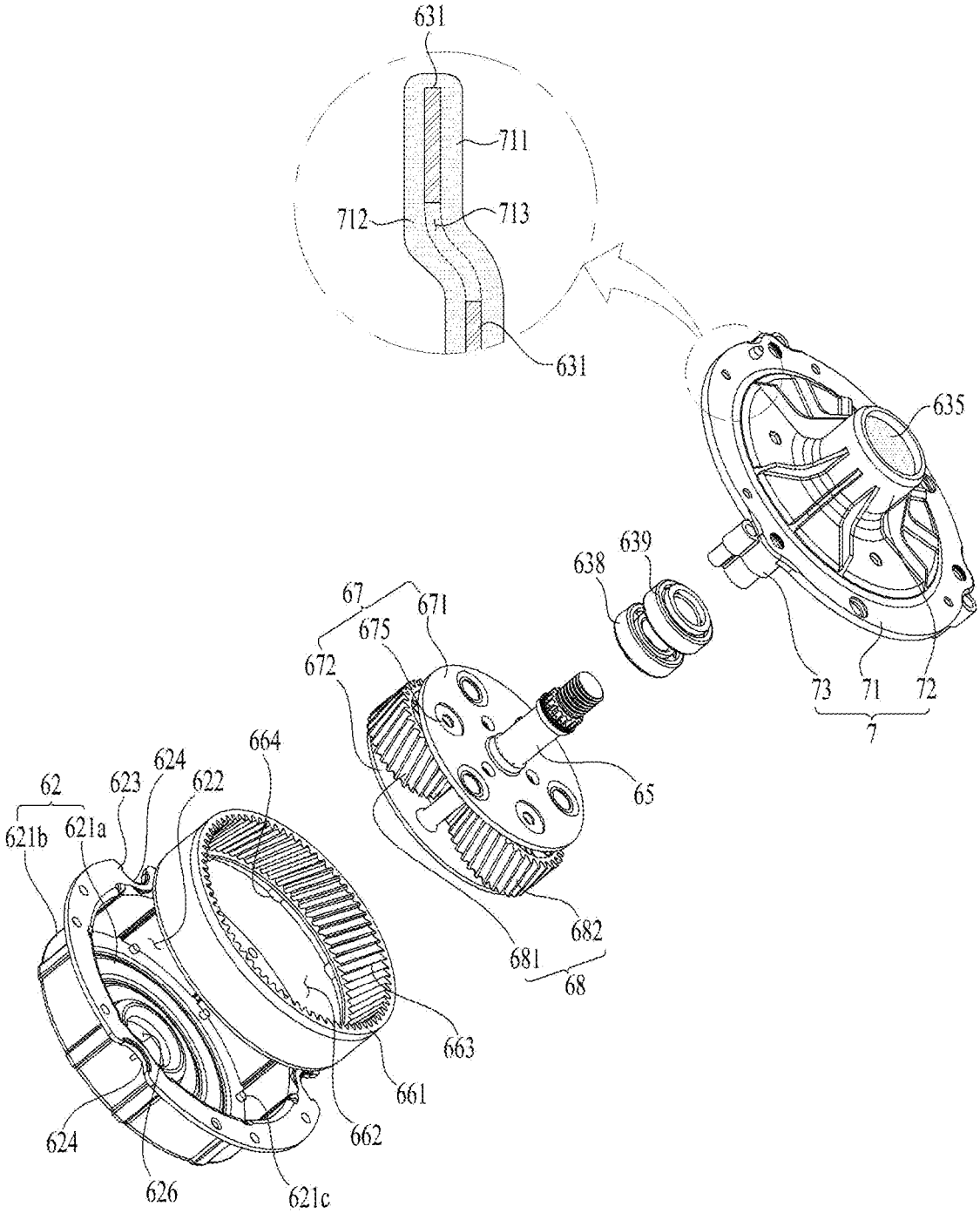

The heat insulation part 7 can include a cover insulation body 71, which can be coupled to the cover body 631, and a support portion insulation body 72, which surrounds the circumferential surface of the output shaft support portion 635. As shown in FIG. 10, the cover insulation body 71 can include at least one of a first insulation body 711, which is defined at the surface of the cover body 631 that faces the fixing panel 151 in the space defined by the cover body 631, or a second insulation body 712, which is defined at the surface of the cover body 631 that faces the housing body 62 in the space defined by the cover body 631.

When the cover insulation body 71 includes both the first insulation body 711 and the second insulation body 712, it is desirable for the cover insulation body 71 to further include a connection body 713, which passes through the cover body 631 to connect the first insulation body 711 to the second insulation body 712. In some implementations, the cover body 631 can have a cover through-hole 636 defined therein and configured to allow the connection body 713 to be located therein.

As shown in FIG. 11, the heat insulation part 7 can further include a mounting portion insulation body 73, which surrounds the mounting portion 637. The reason for this is to minimize the transfer of heat from the motor 5 to the cover body 631 through the mounting portion 637. In some implementations, the mounting portion insulation body 73 is disposed to surround the entire area of the circumferential surface of the mounting portion 637.

In order to facilitate coupling of the stator 51 and the mounting portion 637, the laundry treating apparatus can further include a stator position setting unit 74. In some implementations, the stator position setting unit 74 can include a bracket protrusion 741, which is disposed at the stator bracket 515, and a protrusion accommodation recess 742, which is disposed at the second insulation body 712 and configured to allow the bracket protrusion 741 to be inserted thereinto.

In some implementations, the heat insulation part can be coupled to the fixing panel 151 so as to be disposed between the housing cover 63 and the fixing panel 151, or can be coupled to the fixing panel 151 so as to be disposed between the fixing panel 151 and the rear cover 23. In some implementations, the heat insulation part can surround the fixing panel through-hole 153, and can be formed as a plate having a diameter larger than the diameter of the cover body.

In some implementations, in the power transmission unit 6, the gear unit G can be disposed at the accommodation space 622 defined by the housing body 62. That is, the ring gear 66, the driving gear 69, and the driven gear 68 are provided so as to be prevented from escaping the accommodation space 622. In some implementations, the accommodation space 622 can be defined only in the housing body 62 to dispose the gear unit G as far as possible from the fixing panel 151 (the heat transmission medium radiating the heat in the cabinet to the outside of the cabinet). Accordingly, the laundry treating apparatus 100 is capable of minimizing deterioration in the durability of the gear unit G.

In some implementations, when the driving gear 69 and the driven gear 68 rotate, repulsive force acting between the gears can be transmitted to the input shaft 64 and the output shaft 65. That is, when the driving gear and the driven gear rotate, external force acting in a direction away from the housing H or in a direction toward the inside of the housing H can be input to the input shaft 64 and the output shaft 65. In some implementations, the above-described operation can be more effectively realized when the driving gear, the driven gear, and the ring gear are implemented as helical gears.

Figure 12:
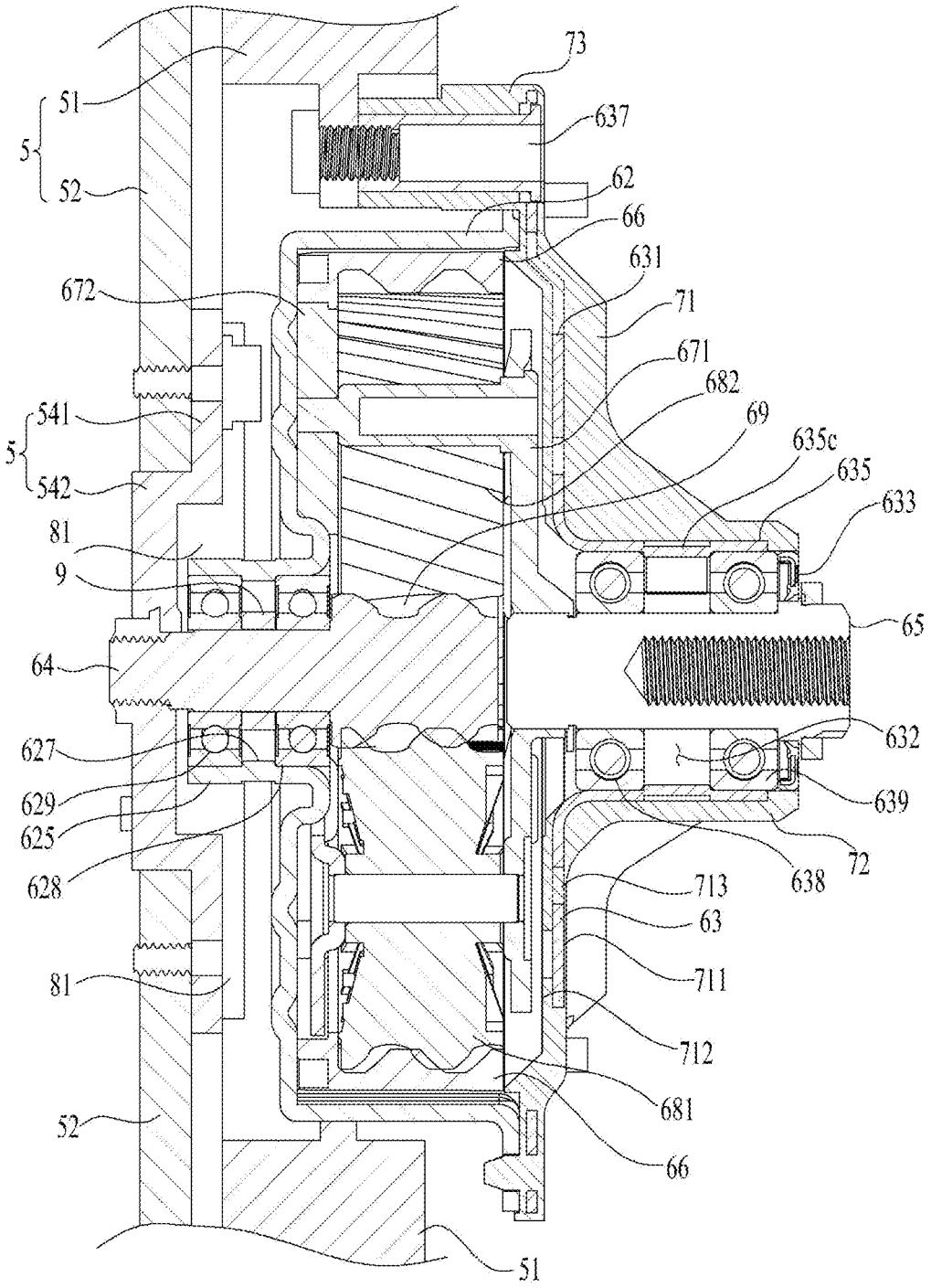
FIGS. 12 and 13 are schematic views illustrating the cross-section of the power transmission unit.

As shown in FIG. 12, the laundry treating apparatus 100 can include a damper 9 configured to minimize the risk of separation of the input shaft 64 from the input shaft bearings 628 and 629 or the input shaft support portion 625 due to external force acting on the input shaft 64.

The damper 9 can be disposed at the input shaft through-hole 626 so as to be located between the first input shaft bearing 628 and the second input shaft bearing 629, and is configured to serve to reduce the transmission of vibration of the first input shaft bearing 628 to the second input shaft bearing 629.

The damper 9 can be implemented as an elastic body (rubber or the like) that is coupled to the circumferential surface of the input shaft 64 and is disposed between the first input shaft bearing 628 and the second input shaft bearing 629. As shown in FIG. 8, the damper 9 can include a damping body 91, which has a diameter larger than the diameter of the input shaft 64 and smaller than the diameter of the input shaft through-hole 626 (a damping body, which has a diameter smaller than the outer diameter of the input shaft bearing), and a damping body through-hole 92, which is defined at the damping body 91 and configured to allow the input shaft 64 to be inserted thereinto.

As shown in FIG. 12, in order to minimize vibration of the housing H, it can be desirable that one surface of the damping body 91 be in contact with the first input shaft bearing 628 and that the other surface of the damping body 91 be in contact with the second input shaft bearing 629.

In some implementations, the input shaft support portion 625 can further include a stopper 627 (a first stopper), which protrudes toward the center of the input shaft through-hole 626 and is disposed between the first input shaft bearing 628 and the second input shaft bearing 629. In some implementations, the first stopper 627 is configured to restrict the range within which the first input shaft bearing 628 moves toward the second input shaft bearing 629, or configured to restrict the range within which the second input shaft bearing 629 moves toward the first input shaft bearing 628.

Since the damping body 91 is coupled to the circumferential surface of the input shaft 64 (since the damping body is provided so as to rotate together with the input shaft), it can be desirable to set the radius of the damping body 91 (the outer radius of the damper) to be shorter than the distance from the center of the input shaft through-hole 626 to the first stopper 627.

In some implementations, in order to minimize the problem of separation of the output shaft bearings 638 and 639 from the housing H due to external force acting on the output shaft 65, the output shaft support portion 635 can include a stopper 635*c* (a second stopper) configured to restrict the movement range of the first output shaft bearing 638 and the movement range of the second output shaft bearing 639. As shown in FIG. 11, the output shaft support portion 635 can include a first mounting portion 635*a*, in which the first output shaft bearing 638 is disposed, and a second mounting portion 635*b*, in which the second output shaft bearing 639 is disposed. In some implementations, the second stopper 635*c* can be formed as a protrusion that is disposed between the first mounting portion 635*a* and the second mounting portion 635*b*.

In some implementations, in order to minimize the transfer of heat to the inside of the housing H and to dissipate heat from the housing H to the outside, the laundry treating apparatus can further include a heat dissipation part 8. As shown in FIG. 8, the heat dissipation part 8 can include at least one of a first heat dissipation part 81, which is disposed at the coupling body 541 and configured to discharge air present between the housing body 62 and the rotor 52 to the outside of the rotor 52, or a second heat dissipation part 82, which is disposed at the circumferential surface 621*b* of the housing body and configured to dissipate the heat in the accommodation space 622 to the outside of the accommodation space 622.

The first heat dissipation part 81 can be formed as a blade that protrudes from the coupling body 541 toward the housing base 621*a*. In some implementations, the coupling body 541 and the first heat dissipation part 81 are configured to rotate, based on the rotor rotating, so air present between the rotor 52 and the housing body 62 can be discharged to the outside of the rotor 52 through the rotor through-hole 531, with the result that the temperature of the housing H drops.

In some implementations, the first heat dissipation part 81 can be formed as a plurality of blades and the blades can be radially disposed about the shaft coupling hole 543. In some implementations, only a single blade may be provided at the coupling body 541.

Meanwhile, when the coupling body 541 includes the coupling body bent portion 542, it can be desirable for the first heat dissipation part 81 to be formed as a blade extending from the coupling body bent portion 542 to the edge of the coupling body 541. This enables the height of the blade (the length of the blade in a direction from the coupling body toward the housing body) to be increased, thereby increasing the amount of air that is discharged.

The second heat dissipation part 82 can be disposed as at least one of a housing protruding portion (a cooling fin or the like) that protrudes from the housing circumferential surface 621*b* or a housing bent portion (a bent recess or the like) that is bent from the housing circumferential surface 621*b* toward the accommodation space 622. In some implementations, the second heat dissipation part 82 serves to increase the surface area of the housing circumferential surface 621*b*, thereby facilitating heat exchange between the housing body 62 and external air.

Hereinafter, the operation process of the above-described power transmission unit 6 will be described with reference to FIG. 13.

Figure 13:
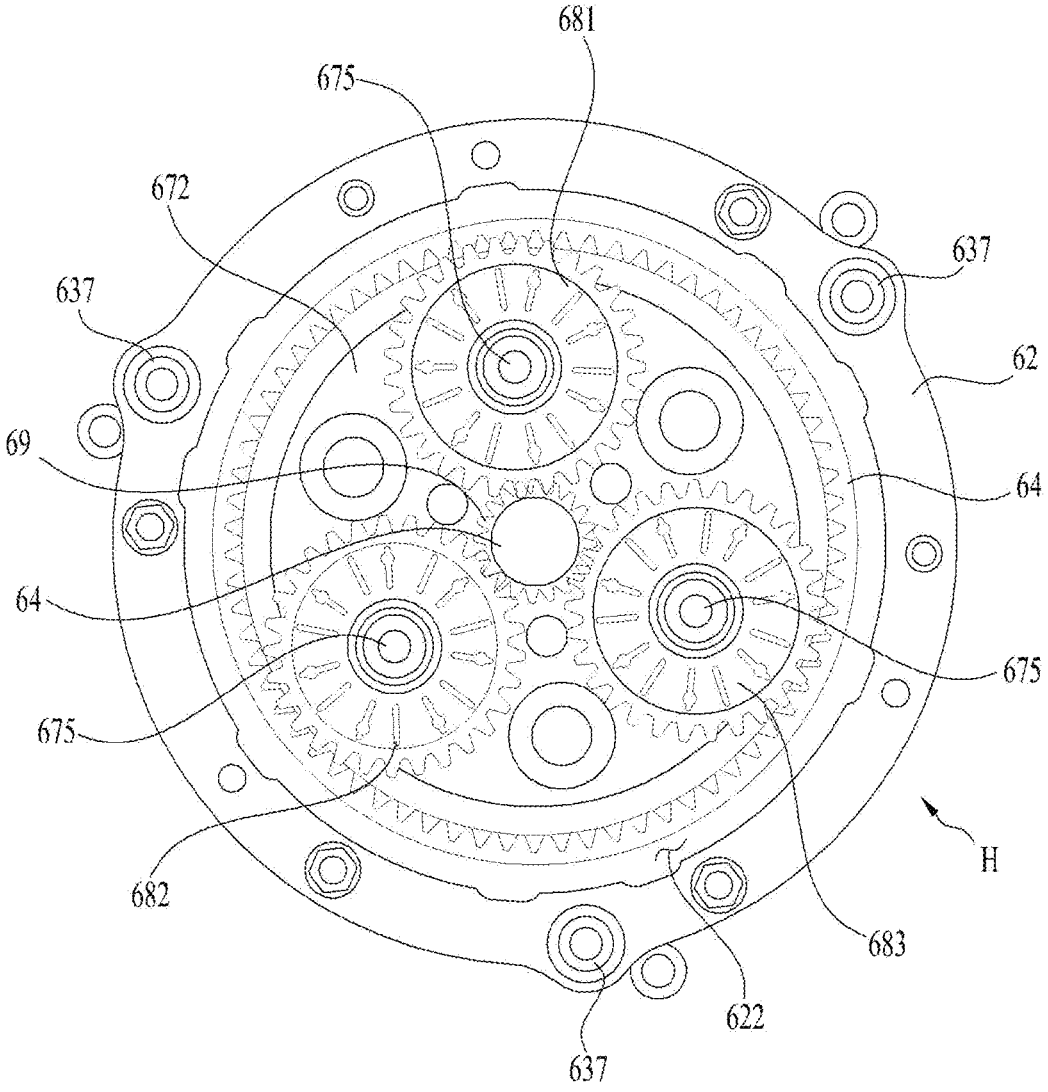

FIG. 13 illustrates an example state of the inside of the housing body 62. When the rotor 52 rotates, the input shaft 64 rotates. When the driving gear 69 is rotated by the input shaft 64, the driven gears 681, 682, and 683, which are engaged with the driving gear 69, are also rotated. Since the driven gears 681, 682, and 683 can be engaged with the ring gear 66, which is coupled to the housing body 62, when the driven gears 68 rotate, the cage 67 and the output shaft 65 rotate, and the drum 2, which is coupled to the output shaft 65, also rotates.

In some implementations, a portion of the heat supplied to the drum 2 by the drying unit 3 can be radiated to the outside of the drum 2 (the inside of the cabinet), and the heat in the cabinet can be radiated to the outside of the cabinet. If the heat radiated from the cabinet 1 is transferred to the inside of the housing H of the power transmission unit 6, the durability of the gear unit G can be deteriorated. However, in the laundry treating apparatus 100, the heat insulation part 7 is configured to minimize the transfer of heat to the inside of the housing H, thus reducing the risk of deterioration in the durability of the gear unit G.

In some implementations, since the laundry treating apparatus 100 includes the first heat dissipation part 81, which is provided at the coupling body 541 coupling the input shaft 64 to the rotor 52, the second heat dissipation part 82, which is disposed at the housing circumferential surface 621*b*, and the motor heat dissipation part 53, which is provided at the rotor, it is possible to minimize the occurrence of the state in which the stator 51 is overheated during rotation of the rotor 52 (during rotation of the drum) and the state in which the accommodation space 622 is overheated.

The above-described laundry treating apparatus can be modified and implemented in various forms, and the scope of the present disclosure is not limited to the embodiments set forth herein.

What is claimed is:

1. A laundry treating apparatus comprising:

a drum including:

a drum body defining a space to receive laundry therein, a front cover defining a front surface of the drum body, a rear cover defining a rear surface of the drum body, and a drum introduction opening defined at the front cover and configured to communicate with an inside of the drum body;

a drying unit configured to supply heated air to the drum body;

a fixing panel disposed at a position spaced apart from the rear cover;

a power transmission unit including:

a housing coupled to the fixing panel, an input shaft having one end disposed at an outside of the housing and an opposite end disposed in the housing, an output shaft having one end coupled to the rear cover and an opposite end disposed in the housing, and a gear unit disposed in the housing and configured to transmit rotational motion of the input shaft to the output shaft;

a motor including:

a stator coupled to the fixing panel or the housing and configured to form a rotating magnetic field, and a rotor configured to be rotated by the rotating magnetic field and to allow the one end of the input shaft to be coupled thereto; and a heat insulation part made of a material having heat conductivity lower than heat conductivity of the housing and configured to reduce an amount of heat that is transferred from the outside of the housing to an inside of the housing.

2. The laundry treating apparatus of claim 1, wherein the heat insulation part is disposed at a surface of the housing that faces the fixing panel.

3. The laundry treating apparatus of claim 2, wherein the housing is coupled to the fixing panel so as to be disposed in a space isolated from a space in which the drum is located.

4. The laundry treating apparatus of claim 2, wherein the heat insulation part is made of a material having heat conductivity lower than heat conductivity of the fixing panel.

5. The laundry treating apparatus of claim 2, wherein the housing comprises:

a housing body having a hollow cylindrical shape, the housing body having an opening disposed at a surface thereof that faces the fixing panel; and a housing cover coupled to the housing body and configured to close the opening, and wherein the heat insulation part is disposed at the housing cover.

6. The laundry treating apparatus of claim 5, wherein the housing body and the housing cover are made of a metallic material, and the heat insulation part is made of a non-metallic material.

7. The laundry treating apparatus of claim 5, wherein the housing cover comprises:

a cover body surrounding the opening;

an output shaft through-hole defined at the cover body and configured to allow the output shaft to be inserted thereinto; and an output shaft support portion protruding from the cover body toward the fixing panel and surrounding the output shaft through-hole, and wherein the heat insulation part includes:

a cover insulation body coupled to the cover body; and a support portion insulation body surrounding a circumferential surface of the output shaft support portion.

8. The laundry treating apparatus of claim 7, wherein the housing cover further comprises a bent portion formed such that a region of the cover body in which the output shaft through-hole is defined protrudes toward the fixing panel.

9. The laundry treating apparatus of claim 7, wherein the housing cover and the cover insulation body are formed integrally with each other.

10. The laundry treating apparatus of claim 7, wherein the cover insulation body comprises:

a first insulation body disposed at a surface of the cover body that faces the fixing panel in a space provided by the cover body; and a second insulation body disposed at a surface of the cover body that faces the housing body in a space provided by the cover body.

11. The laundry treating apparatus of claim 10, further comprising:

a cover through-hole defined at the cover body; and a connection body inserted into the cover through-hole and connecting the first insulation body to the second insulation body.

12. The laundry treating apparatus of claim 11, wherein the cover insulation body is coupled to the housing cover via insert injection molding.

13. The laundry treating apparatus of claim 7, further comprising:

an output shaft bearing disposed inside the output shaft support portion and configured to rotatably secure the output shaft to an inside of the output shaft support portion; and a seal coupled to the output shaft support portion and configured to restrict introduction of external air into the output shaft bearing.

14. The laundry treating apparatus of claim 7, further comprising:

a mounting portion provided at the cover body and configured to allow the stator to be detachably secured thereto.

15. The laundry treating apparatus of claim 14, wherein the heat insulation part further comprises a mounting portion insulation body surrounding the mounting portion.

16. The laundry treating apparatus of claim 15, wherein the stator comprises:

a core having a ring shape;

a plurality of support bars protruding radially from an outer circumferential surface of the core;

a core insulation part surrounding the core;

a plurality of support bar insulation parts disposed at the core insulation part to surround respective ones of the plurality of support bars;

a coil disposed at each of the plurality of support bar insulation parts; and a stator bracket disposed at an inner circumferential surface of the core insulation part so as to be coupled to the mounting portion.

17. The laundry treating apparatus of claim 16, further comprising:

a bracket protrusion defined at the stator bracket; and a protrusion accommodation recess defined in the cover insulation body and configured to allow the bracket protrusion to be inserted thereinto.

18. A laundry treating apparatus comprising:

a drum including:

a drum body defining a space to store laundry therein, a front cover defining a front surface of the drum body, a rear cover defining a rear surface of the drum body, and a drum introduction opening defined at the front cover and configured to communicate with an inside of the drum body;

a drying unit configured to supply heated air to the drum body;

a fixing panel disposed at a position spaced apart from the rear cover;

a power transmission unit including:

a housing coupled to the fixing panel, an input shaft having one end disposed at an outside of the housing and an opposite end disposed in the housing, an output shaft having one end coupled to the rear cover and an opposite end disposed in the housing, and a gear unit disposed in the housing and configured to transmit rotational motion of the input shaft to the output shaft;

a motor including:

a stator coupled to the fixing panel or the housing and configured to form a rotating magnetic field, and a rotor configured to be rotated by the rotating magnetic field and to allow the one end of the input shaft to be coupled thereto; and a heat insulation part made of a material having heat conductivity lower than heat conductivity of the fixing panel and heat conductivity of the housing, the heat insulation part being disposed at a position between the housing and the fixing panel or a position between the fixing panel and the rear cover.

* * * * *